US005109890A

United States Patent [19]

Stacher et al.

[11] Patent Number: 5,109,890

[45] Date of Patent: May 5, 1992

[54] LOOM SLEY DRIVE

[75] Inventors: Angelo Stacher, Arbon; Heribert Weber, Diepoldsau, both of Switzerland

[73] Assignee: Sulzer Brothers Limited, Winterthur, Switzerland

[21] Appl. No.: 667,958

[22] Filed: Mar. 12, 1991

[30] Foreign Application Priority Data

Mar. 15, 1990 [CH] Switzerland ..... 01016/90

[51] Int. Cl.[5] ..... D03D 49/62

[52] U.S. Cl. ..... 139/190; 74/519

[58] Field of Search ..... 74/65-68, 74/519; 403/290, 344, 373; 139/190

[56] References Cited

U.S. PATENT DOCUMENTS 4,036,265 7/1977 Malasek et al. ..... 139/190
4,076,048 2/1978 Bolleter et al. .
4,278,111 7/1981 Takahashi et al. ..... 139/190 X
4,625,768 12/1986 Pauwels et al. ..... 139/190 X

FOREIGN PATENT DOCUMENTS 0191955 8/1986 European Pat. Off. .
2528765 6/1977 Fed. Rep. of Germany .
2314282 1/1977 France .
0572117 1/1976 Switzerland .
0590357 8/1977 Switzerland .

*Primary Examiner*—Andrew M. Falik
*Attorney, Agent, or Firm*—Kenyon & Kenyon

[57] ABSTRACT

A sley drive for a loom has a shaft which is eccentric to an axis of rotation in order to provide partial weight balancing for the pivoting movement of the sley. Sley levers are mounted on the sley shaft with each having a clip-shaped part for clamping about the shaft by a screw which passes through legs of the sley levers on the side of the reed relative to the axis of the rotation. Intermediate bearings may also be secured to the sley shaft in the same manner as the sley levers.

15 Claims, 2 Drawing Sheets

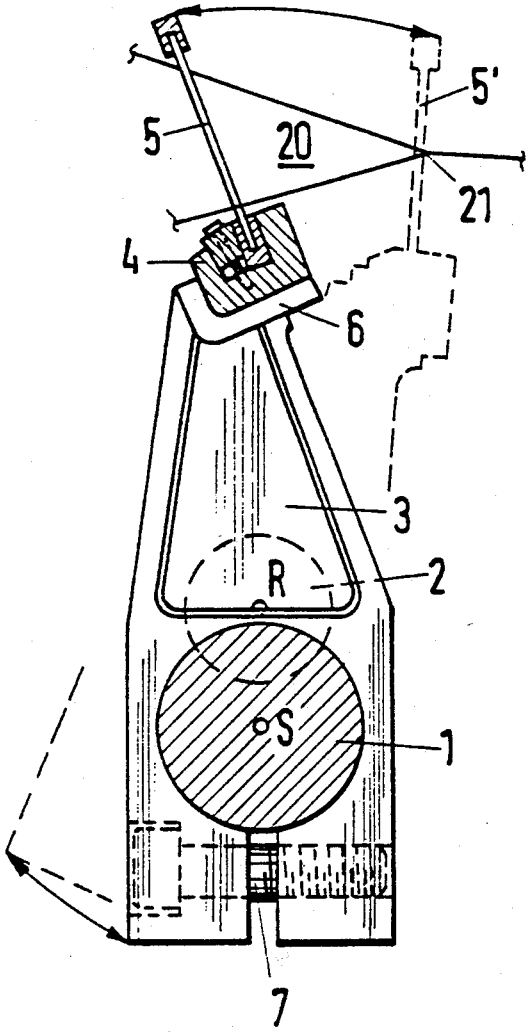
Fig.1
Fig.2
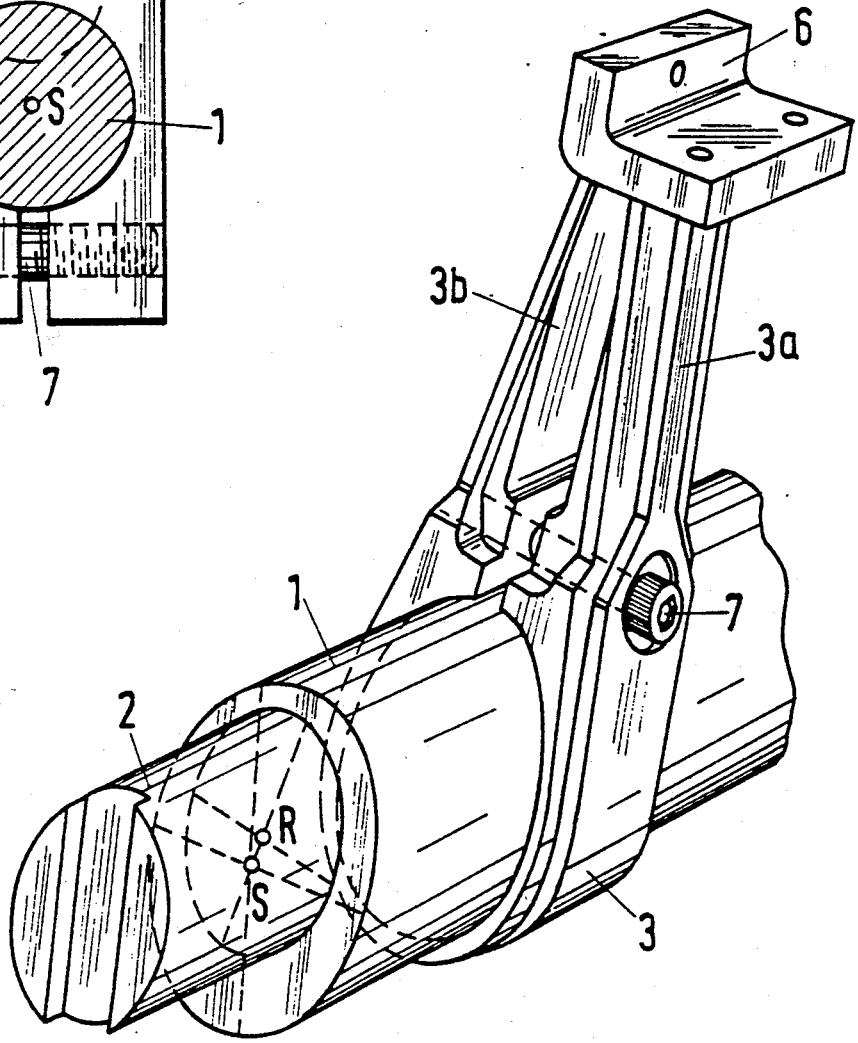

LOOM SLEY DRIVE

This invention relates to a loom sley drive.

As is known, various types of loom sley drives have been known for driving a reciprocating sley shaft for a reed. Examples of such drives are described in German Patent 2,528,765 and French Patent 2,314,282. Generally, such drives include a drive shaft for rotating about an axis of rotation and an eccentrically disposed sley shaft having a center of gravity which is eccentric to the axis of rotation. The sley shaft, in turn, carries pivot levers which in turn carry the reed which is to be reciprocated, i.e. oscillated about the axis of rotation. As is known, the eccentric position of the sley shaft is to be effective to provide weight balancing in order to reduce or even to eliminate inertia forces which arise in operation and which cause vibrations or oscillations. German Patent 2,528,765 also describes sley levers which have a part which engages in clip-shaped fashion around the sley shaft with clamping being effected by means of screws disposed on a side remote from the reed. However, one disadvantage of the known eccentric shaft type of sley drive is that there is a considerable space requirement for the oscillating compensation weight. Further, this space requirement is increased because of the manner in which the sley lever has been secured to the sley shaft.

Accordingly, it is an object of the invention to provide a compact loom sley drive which does not require an inordinate amount of space.

It is another object of the invention to reduce the space requirements for a loom sley drive.

Briefly, the invention provides a loom sley drive which is comprised of a sley shaft having a center of gravity disposed eccentrically of a pivot axis and on a side remote from a reed, a sley lever having a pair of legs disposed in clip-shaped fashion about the shaft and at least one screw securing the legs together in clamping manner on the shaft with the screw disposed on the reed side of the pivot axis.

Still further, the invention provides for the mounting of at least one bearing unit on the sley shaft with the bearing unit including a first part encompassing the shaft with a bearing surface thereon, a second part having a pair of legs disposed in clip-shaped fashion about the shaft and a screw securing the legs of the second part together in clamping manner to the shaft.

In one embodiment, the sley shaft can be disposed within a projected plane of the cross section of the bearing surface of the bearing unit. In another embodiment, the sley shaft can be disposed outside the projected plane of the bearing surface.

The sley drive may also include a pivot shaft which is disposed for rotation about the pivot axis wherein the pivot shaft is disposed entirely within a projected plane of the cross-section of the sley shaft.

In another embodiment, the pivot shaft may be disposed entirely outside the projected plane of the cross-section of the sley shaft.

These and other objects and advantages of the invention will become more apparent from the following detailed description taken in conjunction with the accompanying drawings wherein:

FIG. 1 illustrates a partial side cross-sectional view of a known loom sley drive according to the prior art;

FIG. 2 illustrates a loom sley drive constructed in accordance with the invention;

Figure 4A:
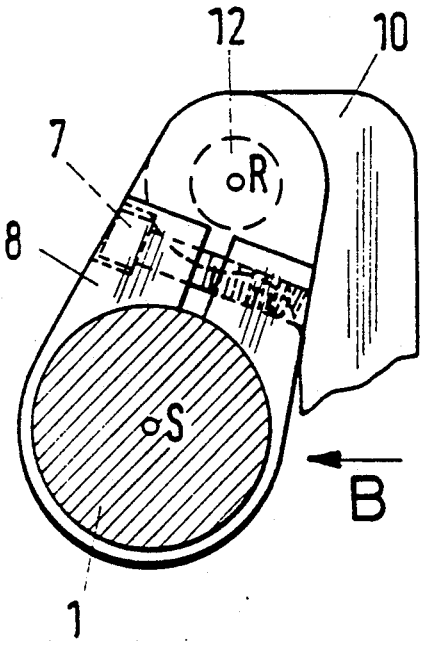
Figure 4B:
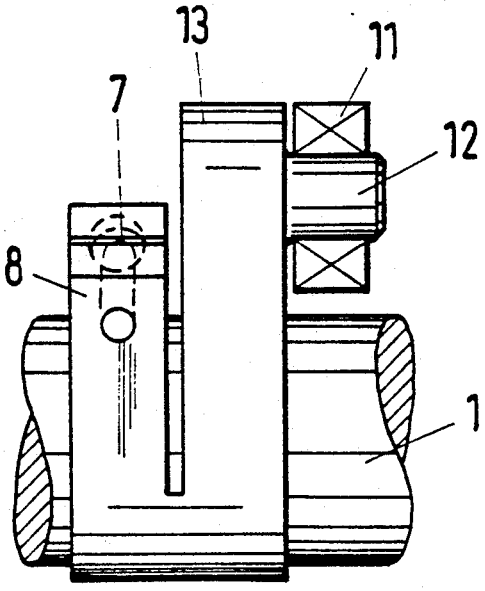

FIG. 4*a* illustrates a partial cross-sectional side of a modified bearing unit in accordance with the invention; and FIG. 4*b* illustrates a front view of the bearing unit drive of FIG. 4*a*.

Referring to FIG. 1, the loom sley drive of known construction generally has a sley shaft 1 disposed with a center of gravity S offset eccentrically from an axis of rotation R of a bearing pin or pivot shaft 2 to which the sley shaft 1 is secured by coupling members as described in U.S. Pat. No. 4,076,048. In contrast to the drive described in German Patent 2,528,765, the cross-section of the pivot shaft 2 is disposed in overlapping relation with the projected plane of the cross-section of the sley shaft 1. In addition, one or more sley levers 3 is secured on the sley shaft 1 in order to carry a sley 4 thereon which, in turn, supports a reed 5 via a fixing angle member 6 on the sley lever 3. As indicated, the bottom part of the sley lever 3 engages in clip-shaped fashion about the sley shaft 1 and is clamped fast by means of a screw 7. In the illustrated position, the sley 4 is in a fully pivoted-out position relative to a shed 20 which is in an open position. The dotted line position of the reed 5' indicates the position of the reed 5' during beating up at a cloth edge 21.

Since the screw 7 is disposed on the side removed from the reed 5, a considerable amount of free space is required in this area of the sley drive for the pivoting movement as indicated by the double arrow.

Referring to FIG. 2, the loom sley drive includes a sley shaft 1 having a center of gravity S disposed eccentrically of a pivot axis R of a pivot shaft 2 and on a side remote from a reed (not shown). As indicated, the pivot shaft 2 is disposed entirely within the projected plane of the cross-section of the sley shaft 1.

In addition, a sley lever 3 is mounted on the sley shaft 1. As indicated, the sley lever 3 has a pair of legs disposed in clip-shaped fashion about the shaft 1 and means in the form of a screw for clamping the legs against the sley shaft 3. As indicated, the screw 7 passes through one leg **3*a* and has a head for abutting against the leg 3*a* within a recessed portion. In addition, the screw 7 has a threaded portion which threads into the other leg 3*b***.

It is to be noted that the screw 7 located on the reed side of the sley shaft 1 is also located on the side of the sley shaft which is opposite the center of gravity S and closet to the axis of rotation R.

The sley lever 3 also includes a fixing angle member 6 which is secured to the two legs **3*a*, 3*b*** at the top, as viewed.

In order to mount the sley lever 3, the legs **3*a*, 3*b* are pushed apart from each other so that the lever 3 can be pushed over the eccentric shaft 1 which is of a constant-cross section along the longitudinal length thereof. Once in place, the two legs 3*a*, 3*b* can be clamped together view the screw 7 and held fast on the shaft 1**.

In the embodiment illustrated, the sley shaft 1 is of circular cross-section; however, other cross-sectional shapes may also be used, such as a rectangular or an equilateral hexagon.

The cross-sectional area of the pivot shaft 2 is disposed completely inside the sley shaft cross-section so that the eccentricity of the sley shaft 1, which is determined by the distance between the center of gravity S and the axis of rotation R is relatively small. However, even a minor eccentricity can provide a welcome reduction in initiating vibrations.

Figure 3:
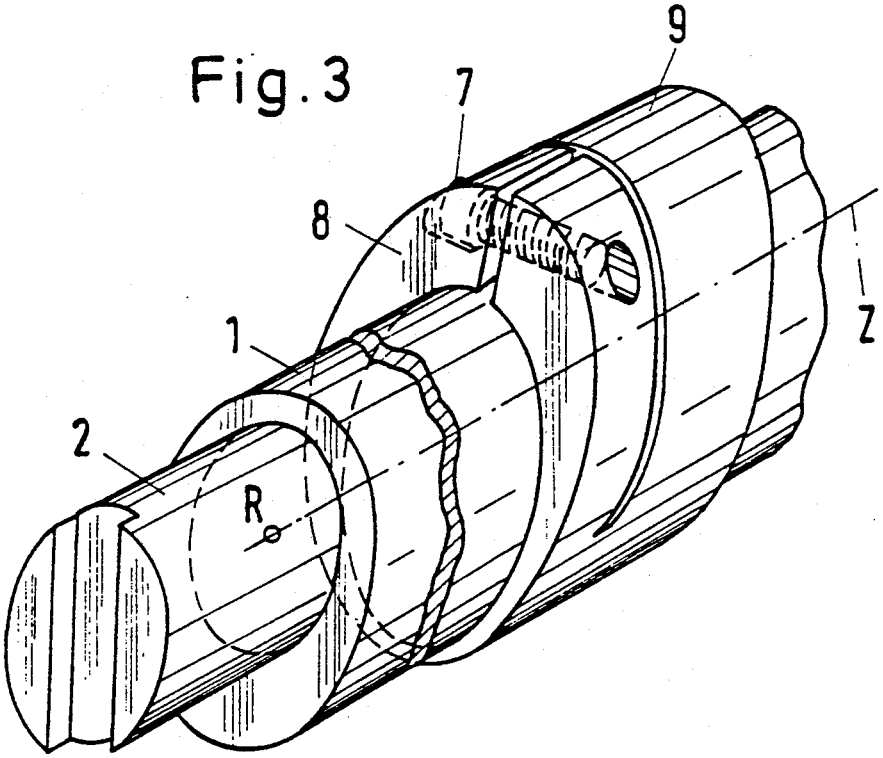
FIG. 3 illustrates a manner of mounting an intermediate bearing on the sley shaft of the loom sley drive of FIG. 2.

Referring to FIG. 3, wherein like reference characters indicate like parts as above, one or more intermediate bearings may also be mounted on the sley shaft 1 particularly where the sley drive is for a wide loom. To this end, a bearing unit is mounted on the sley shaft 1 with the same advantages as the sley lever 3 indicated in FIG. 2, namely less space is required for a pivoting movement. The bearing unit is basically in the form of a cylinder which is formed with an eccentric longitudinal bore for the sley shaft 1. In this case, the center line Z of the bearing unit coincides with the axis of rotation R of the pivot shaft 2. Further, the bearing unit comprises one part 8 having a pair of legs disposed in clip-shaped fashion about the shaft 1 and a screw 7 securing the legs together in clamping manner to the shaft 1. As indicated, the screw 7 is disposed on the reed side of the sley shaft 1. In addition, the bearing unit has a second part 9 encompassing the shaft 1 and having a peripheral bearing surface 9 thereon, i.e. the surface on which the rollers of the intermediate bearing run. As with the sley lever 3 of FIG. 2, the bearing unit can be slid over the shaft 1 when the clip-shaped part 8 is slackened.

As indicated in FIGS. 2 and 3, the loom sley drive is of particualrly compact construction with complete weight balancing being ignored. In this respect, the axis of rotation R is disposed within the plane of the shaft 1 and the sley shaft is disposed entirely within the cross-section of the bearing unit.

If a sley shaft is required to have greater eccentricity, the intermediate bearings can be constructed as indicated in FIGS. 4*a* and 4*b*. FIG. 4*a* illustrates a view of the intermediate bearing taken in the picking direction. As illustrated, the sley shaft 1 is connected to a sley carrier 10 by means of a component which includes a clip-shaped part 8 and a lever part 13. As indicated in FIG. 4*b* which is taken in the direction indicated by arrow B in FIG. 4*a*, the lever part 13 is secured to a bearing pin or pivot shaft 12 which, in turn, is supported by a bearing 11 in the sley carrier 10. A firm connection of the component on the shaft 1 is produced by means of the clip-shape part 8 and the screw 7 in a manner as described above.

As indicated in FIGS. 4*a* and 4*b*, the cross-sectional area of the sley shaft 1 is disposed entirely outside the projected plane of the cross-section of the bearing surface provided by the pivot shaft 12. If the sley shaft is to be of constant cross-section, there is no possibility of an overlap such as shown in FIG. 1 between the intermediate bearings.

A construction for the lateral main bearings which is similar to the construction of FIGS. 4*a* and 4*b* permits greater eccentricity than is present in the case of the embodiment of FIG. 2. In this construction, there can be an overlap in the case of the main bearings between the cross-sectional area of the pivot shaft 2 and the cross sectional area of the sley shaft 1.

The invention thus provides a loom sley drive which is relatively compact construction for the mounting of a sley in a loom.

What is claimed is:

1. A loom sley drive comprising a reed a sley shaft having a center of gravity disposed eccentrically of a pivot axis thereof and on a side remote from said reed;

a sley lever having a pair of legs disposed in clip-shaped fashion about said shaft; and;

at least one screw securing said legs together in clamping manner to said shaft, said screw being disposed on a reed side of said sley shaft.

2. A loom sley drive as set forth in claim 1 further comprising at least one bearing unit mounted on said shaft, said bearing unit including a first part encompassing said shaft and having a bearing surface thereon, a second part having a pair of legs disposed in clip-shaped fashion about said shaft and a screw securing said legs of said second part together in clamping manner to said shaft.

3. A loom sley drive as set forth in claim 2 wherein said shaft is disposed within a projected plane of the cross-section of said bearing surface.

4. A loom sley drive as set forth in claim 2 wherein said shaft is disposed outside a projected plane of the cross-section of said bearing surface.

5. A loom sley drive as set forth in claim 1 wherein said shaft has a constant cross-section along the length thereof.

6. A loom sley drive as set forth in claim 5 wherein said shaft is of circular cross-section.

7. A loom sley drive as set forth in claim 1 wherein said pivot axis is disposed within a projected plane of the cross-section of said shaft.

8. In a loom, the combination comprising a pivot shaft disposed for rotation about an axis of rotation;

a sley shaft secured to said pivot shaft for oscillation about said axis of rotation, said shaft having a center of gravity eccentric to said axis of rotation;

a sley lever having a pair of legs disposed in clip-shaped fashion about said sley shaft; and means for clamping- said legs against said sley shaft, the sley shaft which is closet said means being disposed on a side of said axis of rotation and opposite said center of gravity.

9. The combination as set forth in claim 8 wherein said pivot shaft is disposed entirely within a projected plane of the cross-section of said sley shaft.

10. The combination as set forth in claim 8 which further comprises an angle member secured to said legs for mounting of a reed thereon.

11. The combination as set forth in claim 8 wherein said means is a screw passing through one leg and threaded into the other of said legs.

12. The combination as set forth in claim 8 which further comprises a bearing unit mounted on said sley shaft, said bearing unit including a first part encompassing said shaft and having a bearing surface thereon, and a second part having a pair of legs disposed in clamping relation about said sley shaft.

13. The combination as set forth in claim 12 which further comprises a screw securing said legs of said second part together in clamping manner to said sley shaft, said screw being disposed on a side of said axis of rotation opposite said center of gravity.

14. In a loom, the combination comprising a pivot shaft disposed for rotation about an axis of rotation;

a sley shaft spaced in parallel relation to said pivot shaft for oscillation about said axis of rotation and having a center of gravity eccentric to said axis of rotation; and a bearing unit including a first part encompassing said sley shaft and secured to said pivot shaft, a second part having a pair of legs disposed in clamping relation about said sley shaft and means for clamping said legs to said sley shaft, said means being disposed between said axis of rotation and said center of gravity.

15. The combination as set forth in claim 14 wherein said means is a screw.

* * * * *

UNITED STATES PATENT AND TRADEMARK OFFICE

CERTIFICATE OF CORRECTION

PATENT NO. : 5,109,890

DATED : May 5, 1992

INVENTOR(S) : Stacher et al.

It is certified that error appears in the above-identified patent and that said Letters Patent is hereby corrected as shown below:

Column 3, line 42, change "clip-shape" to --clip-shaped--

Column 4, line 32, delete "the sley shaft which is closest"

4, line 33, change "of said " to --of the sley shaft which is closest said--.

Signed and Sealed this

Seventh Day of December, 1993

Bruce Lehman

*Attest:*

BRUCE LEHMAN

*Attesting Officer*

*Commissioner of Patents and Trademarks*